United States Patent [19]

Chen

[11] Patent Number: 4,821,751

[45] Date of Patent: Apr. 18, 1989

[54] COSMETIC CASE WITH DETACHABLE PLATES

[76] Inventor: James S. K. Chen, 3F., No. 189, Sec. 4, Hsin-I Rd., Taipei, Taiwan

[21] Appl. No.: 106,458

[22] Filed: Oct. 9, 1987

[51] Int. Cl.[4] ..... A45D 33/00

[52] U.S. Cl. ..... 132/295; 206/823; 206/581; 220/338; 132/315

[58] Field of Search ..... 132/82 R, 82 C, 82 D, 132/82 E, 82 F, 83 R, 83 C, 83 F, 83 G, 79 R, 79 D, 79 F, 79 G; 206/823, 581, 509, 506, 512, 558, 557, 564; 220/337, 338

[56] References Cited

U.S. PATENT DOCUMENTS 3,342,190 9/1967 Hultgren et al. ..... 132/83 R 4,589,431 5/1986 Yuhara ..... 132/83 R

*Primary Examiner*—Gene Mancene

*Assistant Examiner*—Adriene J. Lepiane

*Attorney, Agent, or Firm*—Leonard Bloom

[57] ABSTRACT

A cosmetic case with detachable plates which comprises a base plate, lip-stick plates, a plurality of plates for creme, eye shadow cosmetic and a lid. An axle is provided at one edge of the base plate so that the lip-stick plates, eye-shadow plate and the lid can be respectively disposed with collor onto the axle of the base plate. Each of the collars extends in a direction with at least one pair of collars extending in a direction different than that in which at least one other pair of collars extends. This cosmetic case structure is provided with multi-functions and the plates can be optionally detached or combined according to one's desire.

10 Claims, 3 Drawing Sheets

COSMETIC CASE WITH DETACHABLE PLATES

BACKGROUND OF THE INVENTION

The present invention relates to a cosmetic case with detachable plates, more particularly, it relates to a cosmetic case with more than one plate for various kinds or colors of cosmetics which can be changed or replaced. These plates are provided with different types/colors of cosmetics, and if certain colors of cosmetics are fully used up or there is a need to change a certain plate of color, the particular plate is taken out from the base plate and replaced with another plate with a new type/-color of cosmetics.

In conventional cosmetic cases, usually merely a single color cosmetics can be found. For instance, in a conventional eye-shadow cosmetic case, only particular colors of eye-shadow cosmetics can be found, other cosmetics such as creme, powder make-up, lipstick, and etc. are usually found in another cosmetic case. As a result, different cases of lipstick, eye-shadow creme, powder make-up, etc. have to be separately carried along, which are too bulky and inconvenient to place in a lady's bag, and furthermore, it is not economical to have these cosmetics at the same time.

SUMMARY OF THE INVENTION

It is therefore a primary object of the present invention to overcome the foregoing and other disadvantages of a conventional cosmetic case.

A further object of the present invention is to provide a cosmetic case with detachable plates which is lightweight and simple to construct.

A further object of the present invention is to provide a cosmetic case in which a plurality of plates can be mounted to the axle of the base plate.

A further object of the present invention is to provide a cosmetic case which is easily assembled and disassembled and may be produced at a very low cost.

Another object of the present invention is to provide a cosmetic case which has a sense of beauty and convenience to carry.

It is another object of this invention to provide a cosmetic case, whereas, by dismantling of plates, different colors of cosmetics can be replaced.

These, and other objects and advantages of the present invention, will become more apparent from a consideration of the following detailed description of the preferred embodiments, when read in conjunction with the accompanying drawings.

DETAILED DESCRIPTION OF THE PREFERRED EMBODIMENT

Figure 1:
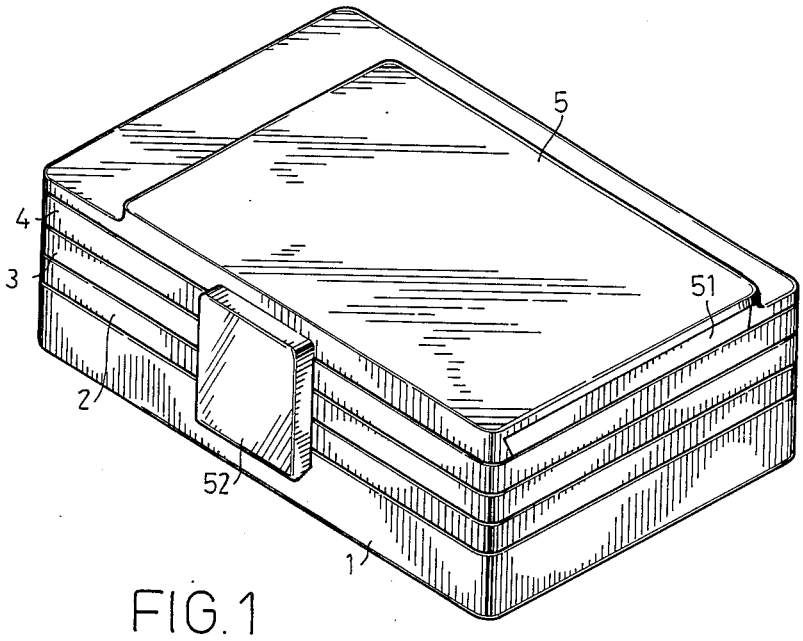
FIG. 1 is a perspective view of a cosmetic case with detachable plates in accordance with the subject of the present invention.
Figures 2, 2A:
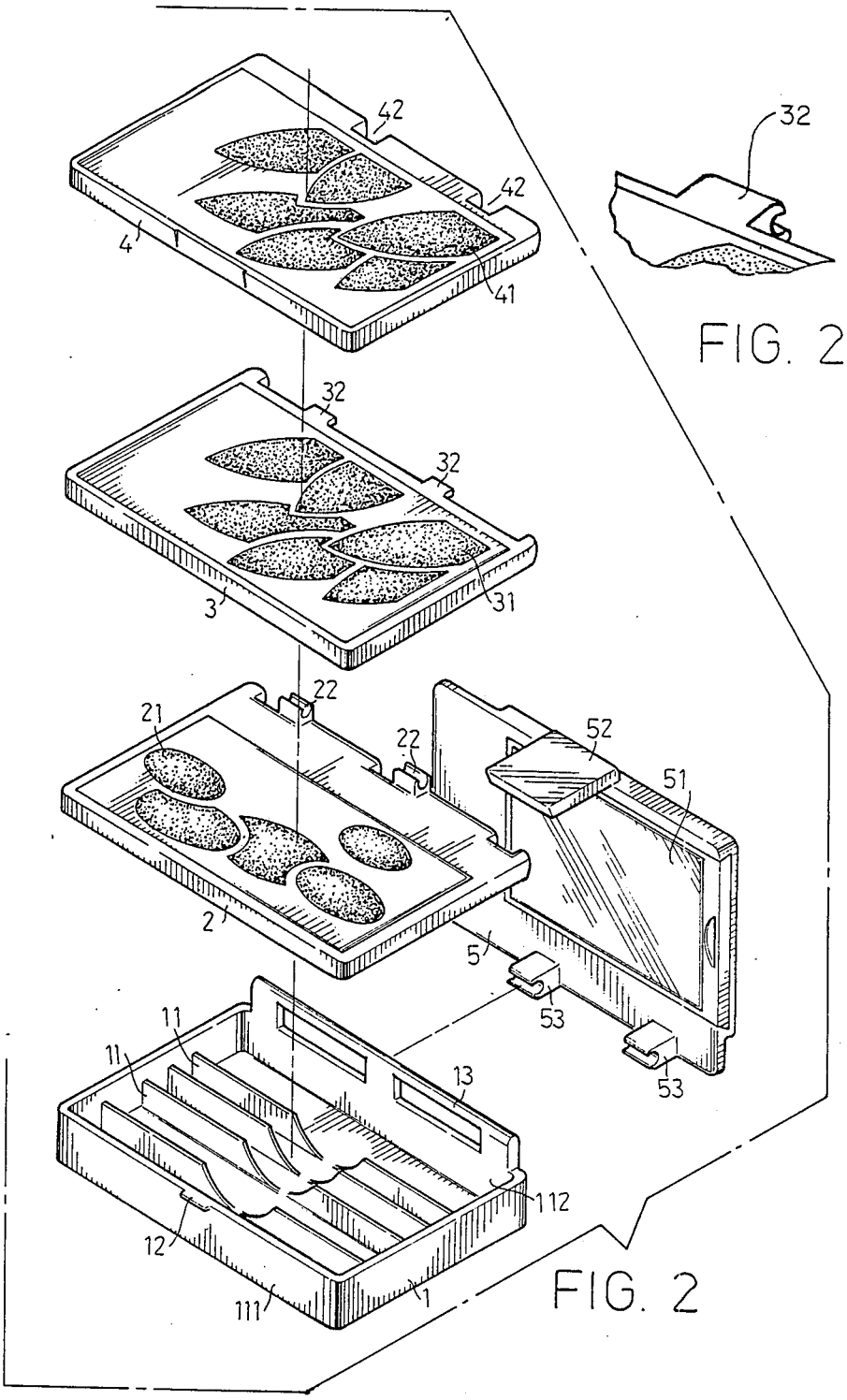
FIG. 2 is an exploded view of a cosmetic case in accordance hwith the present invention.
FIG. 2A is a detailed view showing the arch-shaped hinge collars.

Referring now to FIGS. 1 and 2, an exemplary preferred embodiment of a cosmetic case with detachable plates of the present invention is illustrated in which it comprises of a base plate (1), a lip-stick plate (lowermost cosmetic plate) (2), creme make-up plate (middle cosmetic plate) (3), eye shadow cosmetic plate (uppermost cosmetic plate) (4) and a lid (5). A plurality of partitions (11) are provided on the base plate (1), a front lateral edge (111) is provided with a fastening hook (12) and at the rear face (112) of said base plate (1) an axle (13) is provided for the mounting of the above-mentioned plates (2),(3),(4),(5).

Within the lipstick plate (2), different colors of lipstick (21) are found, and at the rear edge, thereof, two arch-shaped collars (a pair of upwardly extending hinge collars) (22) are mounted. By means of a force (producing elastic deformation of the hinge collars), said collars (22) can be pivotally engaged with said axle (13) of said base plate (1).

Referring to FIG. 2, within the creme make-up plate (3), particular colors of creme (31) are arranged within the plate (3). Like the lipstick plate (2), two arch-shaped collars (a pair of downwardly extending hinge collars) (32) are provided at the rear lateral edge, which by means of a force (producing elastic deformation of the hinge collars), said collars (32) can be pivotally engaged to said axle (13).

Eye-shadow plate (4) is provided with various colors of eyeshadow cosmetics, and two collars (a pair of rearwardly extending hinge collars) (42) are provided at a rear lateral edge of the plate (4), thereof, the mounting of this plate (4) into the axle (13) of the baseplate (1) is the same as the above plates (2) (3).

Figure 3:
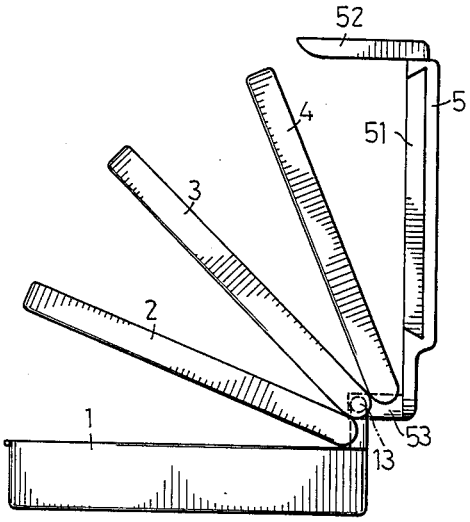
FIG. 3 is an elevational view of a cosmetic case with detachable plates showing the positions of the plurality of plates mounted to the axle of the base plate.
Figure 4:
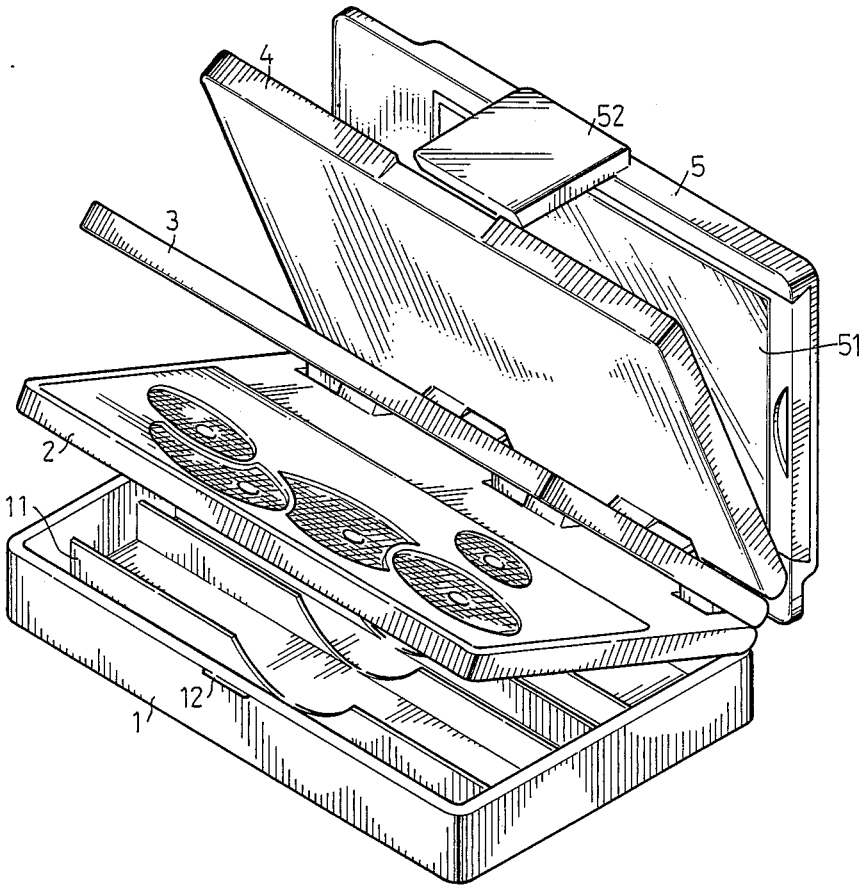
FIG. 4 is a preferred embodiment in accordance with the present invention.

Referring to FIG. 1 and FIG. 4, it can be seen that the inner surface of lid (5) is mounted with a mirror (51). At the front lateral edge, a fastening means (52) is mounted. At the rear lateral edge thereof, two arch-shaped collars (a pair of downwardly extending hinge collars) (53) are provided such that the collars (53) can be easily and pivotally disposed onto the axle (13) of said base plate, and rotated about the axle (13) for pivotal movement between a first open position (FIG. 3) and a second closed position (FIG. 1).

The positions of the above-mentioned collars (22,32,42,53) are provided alternately on the respective plates (1,2,3,4) and lid (5). Also, as can perhaps best be seen by reference to FIGS. 2 and 4, each of the collars (22, 32, 42, 53) extend in a direction, such that in the second closed position at least one pair of said hinge collars formed on one of the second edges extends in a direction that is different than the direction in which at least one other pair of hinge collars extends. In FIGS. 2 and 4, the hinge collars (22) formed on the second edge of cosmetic plate (2) is extend upwardly, the hinge collars (42 and 53) extend downwardly opposite thereto, and the hinge collars (32) extend rearwardly. As a result, these collars (22,32,42,53) can be pivotally engaged on the axle (13) of base plate (1), and these plates (1,2,3,4,5) are combined to form a compact cosmetic case by means of the fastening means (52) of lid (5) hooking onto the fastening hook (12) of the base plate (1). To use, the user may push the fastening means (52) upward and the plates (1,2,3,4,5) can be separatedly opened. These plates can be detached from the axle (13) of base plate (1) if desired.

As various possible embodiments might be made of the above invention, and as various modifications might be made in the embodiment above set forth, it is to be understood that all matter herein described or shown in the accompanying drawings is to be interpreted as illustrative and not in a limiting sense. Thus, it will be appreciated that the drawings are exemplary of a preferred embodiment of the invention.

I claim:

1. A cosmetic case with detachable plates comprising:

(a) a substantially rectangular base plate having a plurality of partitions therein, a fastening hook being provided at a first edge of said base plate and, at a second edge parallel to said first edge being an axle running along said second edge thereof;

(b) a plurality of substantially rectangular plates having a pair of arch-shape collars formed at one edge thereof for each said plate, said plurality of plates being provided with different cosmetics and colors of cosmetics;

(c) a substantially rectangular lid including an inner surface, said lid having a mirror being mounted at the inner surface thereof, and at an edge thereof being provided with a fastening means, such that said fastening means can be engaged with said fastening hook of said base plate, and a second edge of said lid being provided with a pair of collars, such that the collar thereof can be pivotally engaged with said axle of said base plate; and (d) each of said collars extend in a direction, at least one pair of said collars formed on one of the edges extending in a direction different than the direction in which at least one other pair of collars extends.

2. A cosmetic case for carrying a plurality of cosmetics therein, said case comprised of:

a base plate having a first edge and a second opposite edge, said edges arranged parallel to one another;

a lid having a first edge and a second opposite edge, said edges arranged parallel to one another;

at least one cosmetic plate positioned between the base plate and the lid, each of said cosmetic plates having respective first and second edges arranged parallel to one another;

an axle formed along one of the respective second edges;

the other of the second edges having respective pairs of hinge collars formed thereon for removably receiving the axle therein, whereby the second edges of each of the base plate, lid and cosmetic plates are pivotably joined to the axle for pivotal movement thereabout between a first open position and a second closed position; and each of said pair of hinge collars extending in a direction, such that in the second closed position at least one pair of said hinge collars formed on one of the second edges extends in a direction different than the direction in which at least one other pair of said hinge collars extends.

3. The cosmetic case of claim 2, wherein the hinge collars are elastically deformable hinge collars.

4. The cosmetic case of claim 2, wherein the axle is formed along the second edge of the base plate, and wherein in the second closed position the hinge collars of the cosmetic plate extend in an upwardly direction and the hinge collars of the lid extend in an opposite downwardly direction.

5. The cosmetic case of claim 2, further comprised of:

at least two cosmetic plates are positioned between the base plate and the lid, defining an uppermost cosmetic plate and a lowermost cosmetic plate;

the axle being formed along the second edge of the base plate; and wherein in the second closed position, the hinge collars of the lowermost cosmetic plate extend in an upwardly direction, the hinge collars of the uppermost cosmetic plate extend in a rearwardly direction, and the hinge collars of the lid extend in an opposite downwardly direction.

6. The cosmetic case of claim 2, further comprised of:

at least three cosmetic plates are positioned between the base plate and the lid, defining an uppermost cosmetic plate a lowermost cosmetic plate and a middle cosmetic plate therebetween;

the axle being formed along the second edge of the base plate; and wherein in the second closed position, the hinge collars of the lowermost cosmetic plate extend in an upwardly direction, the hinge collars of the lid extend in an opposite downwardly direction and the hinge collars of the middle cosmetic plate extend in a rearward direction.

7. The cosmetic case of claim 6, wherein each of said pairs of hinge collars are formed spaced along the second edges, so as to be staggered relative to one another, and wherein each of the second edges has clearance spaces formed therein to provide clearance for the hinge collars formed on the other second edges.

8. The cosmetic case of claim 2, wherein the base plate has a plurality of partitions formed therein.

9. A cosmetic case for carrying a plurality of cosmetics therein, said case comprised of:

a base plate having a first edge and a second opposite edge, said edges arranged parallel to one another;

a lid having a first edge and a second opposite edge, said edges arranged parallel to one another;

three cosmetic plates positioned between the base plate and the lid thereby defining an uppermost cosmetic plate, a lowermost cosmetic plate and a middle cosmetic plate therebetween, each of said cosmetic plates having respective first and second edges arranged parallel to one another;

an axle formed along the second edge of the base plate;

the other of the said base plate, lid and cosmetic plates having respective pairs of hinge collars formed on the second edges thereof for removably receiving the axle therein, whereby the second edges of each of the base plate, lid and cosmetic plates are pivotably joined to the axle for pivotal movement thereabout between a first open position and a second closed position;

each of said pairs of hinge collars formed spaced along the second edges so as to be staggered relative to one another;

each of said pair of hinge collars extending in a direction, such that in the second closed position at least one pair of said hinge collars formed on one of the second edges extends in a direction different than the direction in which at least one other pair of said hinge collars extends;

wherein in the second closed position, the hinge collars of the lowermost cosmetic plate extend in an upwardly direction and the hinge collars of the lid extend in an opposite downwardly direction and the hinge collars of the middle cosmetic plate extend in a rearward direction; and wherein each of the second edges has clearance spaces formed therein to provide clearance for the hinge collars formed on the other second edges.

10. A cosmetic case for carrying a plurality of cosmetics therein, said case being of the type having a base plte, a lid and at least one cosmetic plate therebetween, each of said base plate, lid and cosmetic plates having respective first and second edges arranged paralled to one another, the second edges of each of the base plate, lid and cosmetic plate being pivotably joined to one another for pivotal movement between a first open position and a second closed position, the improvement thereupon comprising:

an axle formed along one of the respective second edges and extending outwardly therefrom;

the other of the second edges having respective pairs of elastically deformable hinge collars formed thereon for removably receiving the axle therein, whereby the second edges of each of the base plate, lid and cosmetic plates are pivotably joined, each of said pairs of hinge collars formed spaced along the second edge so as to be staggered relative to one another; and each of said pair of hinge collars extending in a direction, such that in the second closed position at least one pair of said hinge collars formed on one of the second edges extends in a direction opposite to the direction in which at least one other pair of said hinge collars extends.

* * * * *